US007476119B2

(12) United States Patent
D'Addario et al.

(10) Patent No.: US 7,476,119 B2
(45) Date of Patent: Jan. 13, 2009

(54) PLUG CONNECTOR

(75) Inventors: James D'Addario, Old Westbury, NY (US); Robert O. Miller, Deer Park, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 2 days.

(21) Appl. No.: 11/788,945

(22) Filed: Apr. 23, 2007

(65) Prior Publication Data

US 2008/0261447 A1 Oct. 23, 2008

(51) Int. Cl.
*H01R 4/24* (2006.01)

(52) U.S. Cl. ..... 439/427; 439/578

(58) Field of Classification Search ..... 439/427, 439/428, 394, 578, 582, 583
See application file for complete search history.

(56) References Cited

U.S. PATENT DOCUMENTS 2,821,682 A * 1/1958 Bauer ..... 324/694
3,836,943 A * 9/1974 Horak ..... 439/394
4,261,632 A * 4/1981 Narozny ..... 439/394
4,374,458 A * 2/1983 Komada ..... 29/857
4,561,708 A * 12/1985 Sorlien et al. ..... 439/99
5,318,458 A * 6/1994 Thorner ..... 439/427
5,403,201 A * 4/1995 McCarthy ..... 439/427
7,115,000 B1 * 10/2006 Huang ..... 439/801
7,121,872 B1 * 10/2006 Hanks ..... 439/427

* cited by examiner

*Primary Examiner*—Hien Vu
(74) *Attorney, Agent, or Firm*—Alix, Yale & Ristas, LLP

(57) ABSTRACT

A plug connector for use with coaxial cable having a central signal wire in which a base member has a bore defined by a side wall adapted to receive the end of a coaxial cable. A member having a pointed end extends into the bore and is adapted to extend into the coaxial cable in contact with the central signal wire. A threaded bore extends through the side wall of the base member and a threaded screw member is mounted in the threaded bore. The screw member is adapted to be driven into the side of the coaxial cable. The screw member has a head portion at one end and a knife edge at the other end, the end having the knife edge having a pocket therein to receive the material of the coaxial cable cut by the knife edge.

15 Claims, 1 Drawing Sheet

PLUG CONNECTOR

FIELD OF INVENTION

This invention relates generally to electrical plug connectors, and more particularly to electrical plug connectors for connecting coaxial cable to electrical devices.

BACKGROUND

Many types of electrical connectors are known. Examples of such connectors are shown in U.S. Pat. Nos. 6,533,617, 6,568,964 and 6,729,912 to D'Addario. The disclosure of each of these patents is incorporated herein by reference in its entirety. The connectors as shown in those patents include a base into which a coaxial connector is inserted. This connector also includes a central probe member which is in electrical contact with the central signal wire of the coaxial cable. As shown in these patents, a set screw or other type of screw is used to secure the coaxial cable within the base of the connector. The set screw is tightened against the outer coating or jacket of the coaxial cable and penetrates the cable.

In some types of coaxial cables, especially those that are known as plenum cable, the outer coating or jacket is relatively tough with the result that a typical screw, when fully tightened, does not penetrate the outer jacket. This results in the possibility of the cable being able to be inadvertently pulled out or dislodged from the connector base, interrupting the electric connection. Accordingly, there exists a need for a connector wherein the connecting screw is effective to prevent withdrawal of the cable from the connector.

SUMMARY OF THE INVENTION

These deficiencies are overcome by a connector having a screw with a sharp edge for cutting the outer jacket of the cable and a pocket associated with the sharp edge for encapsulating the cut region of the jacket.

According to one aspect there is provided a plug connector for use with a coaxial cable having a central signal wire. The connector comprises a body or base member having a bore therein defined by a sidewall adapted to receive the end of a coaxial cable. A central signal probe, pin or other conducting member is provided in the body or base, having one end in the bore to engage the central signal wire of the coaxial cable. A threaded bore extends transversely through the sidewall. A threaded screw member is mounted in the transverse bore and adapted to be driven into the side of a coaxial cable. The screw has a head portion at one end and a knife edge with associated counter bore or similar pocket at the other end.

According to another aspect there is provided an assembled plug connector and coaxial cable comprising a body or base member having a bore therein defined by a sidewall. A coaxial cable having an outer jacket, a conductive ground layer, a central signal wire and an insulating layer between the ground layer and the central signal wire, has one end received within the bore. A central signal probe member is provided in the body or base, having one end that engages the central signal wire of the coaxial cable. A threaded bore extends through the sidewall and a threaded screw member is mounted in the threaded bore into the side of the coaxial cable. The screw member has a head portion at one end and a knife edge with associated counter bore or similar pocket at the other end. With the screw fully advanced, the edges contact the ground layer and the pocket at least partially encapsulates a region of the cable jacket within the edges.

DETAILED DESCRIPTION

Figure 1:
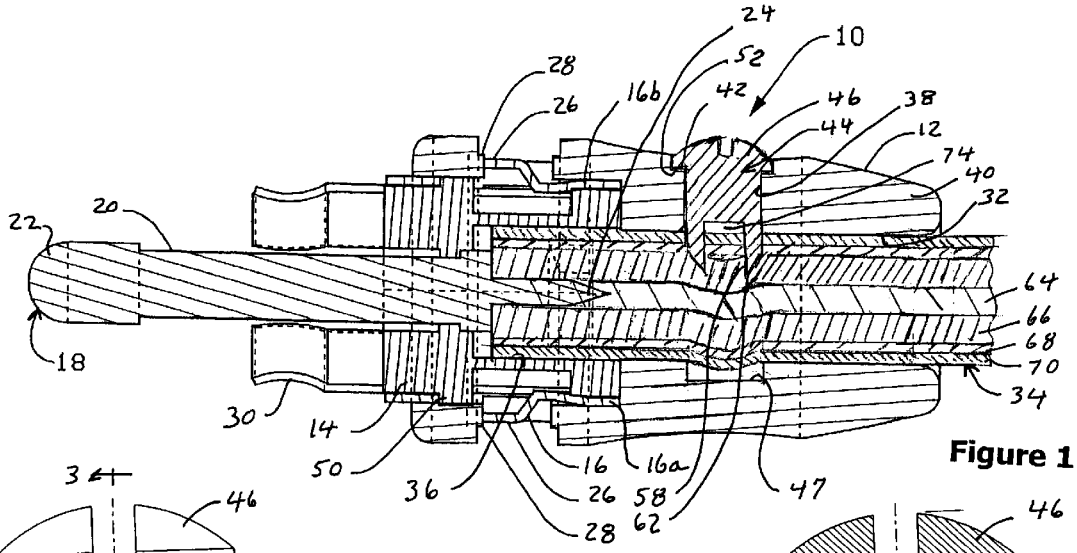
FIG. 1 is a sectional side view of a connector.

Referring to the drawings and in particular FIG. 1, a connector 10 is shown which is of the type generally shown and described in U.S. Pat. No. 6,729,912. Reference should be made to that patent for a detailed description of its construction. However, in general, the connector 10 includes a base 12 and an insulating ring 14 interposed between a conducting ground sleeve 16 and a conductive signal probe member 18. The conducting ground sleeve 16 is preferably formed from two mating half shells 16a and 16b that extend from the base and are disposed annularly about the probe member 18 in substantially coaxial relation. The insulating ring 14 is preferably comprised of a molded plastic material such as a molded thermoplastic, e.g. acetyl resin, nylon, ABS resin and or blends thereof. The conducting ground sleeve 16 is composed of a conductive material and may be formed from sheet stock and is disposed coaxially about the insulating ring 14.

A pin or probe member 18 extends from the base 10 along a central axis and includes a conductive body 20 having a rounded head 22 at the free end thereof and the short needle-like portion 24 at the other end thereof which extends into the base 10. The ground sleeve 16 includes tabs 26 which extend into recesses 28 in the base 10. The ground sleeve 16 also includes a plurality of circumferentially spaced apart spring fingers 30 which are adapted to provide an inward force against a collar of a jack connector (not shown) when the plug connector 10 is installed on a jack connector.

The base 10 includes an axial bore 32 in which a coaxial cable 34 is received. The inner surface 36 of the insulating ring 14 is coextensive with the bore 32 as shown. A radially extending threaded through bore 38 is provided in the wall 40 of the bore 32 and has a counterbore 42. A threaded screw member 44 is received within the threaded bore 38 and includes an externally accessible head portion 46 that is adapted to be tightened against the bottom of the counterbore 42. A radial bore 47 is provided in the internal surface of the wall 40 of the bore 32 in the base 12. The radial bore 47 is directly opposite the threaded bore 38 and coaxial therewith as shown.

The insulating ring 14 is secured within the conductive ground sleeve 16 by protrusions 50 that extend through the sleeve 16 and retain the sleeve 16 in place when the base 10 is secured over the sleeve 16 and insulating ring 14. A ring (not shown) may be positioned about the base 12 to cover the tabs 26 and recesses 28.

Figure 2:
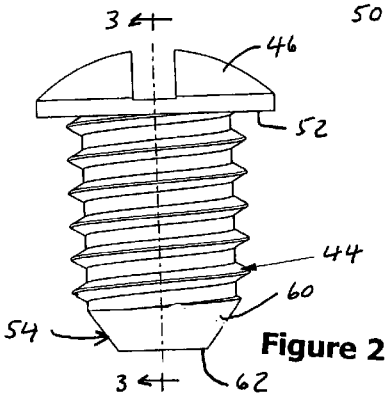
FIG. 2 is a side view of a screw used in the connector of FIG. 1.
Figure 3:
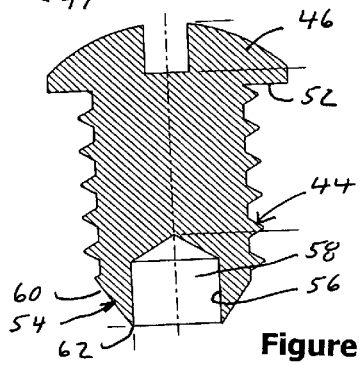
FIG. 3 is a sectional view through the screw of FIG. 2 taken along the lines 3-3 of FIG. 2.

Referring especially to FIGS. 2 and 3, the enlarged head portion 46 of the screw member 44 presents a flat surface 52 that engages the bottom of the counter bore 42 when the screw member 44 is fully driven into the base 12. The free end 54 of the screw member 44 has a bore 56 therein that forms a pocket 58 in the free end 54 of the screw member 44. The free end 54 of the screw member 44 also has a forwardly and inwardly tapering portion 60, which together with the wall of the bore 56 results in the formation of a knife edge 62 at the very tip of the screw member 44. The pocket 58 in the free end 54 of the screw member 44 has a volume sufficient to contain the material of the coaxial conducting cable cut by the knife edge 62 of the screw member 44 as it is being tightened without putting an actual strain on the cable 34.

In operation, with the screw member 44 retracted so that its free end 54 is withdrawn past the inside surface of the wall 40 of the bore 32 of the base 12, the coaxial cable 34 may be inserted into the bore 32. The coaxial cable 34 may be of the conventional type and include a central signal wire 64 surrounded by an insulation layer 66 with a ground braid interposed 68 between the insulation layer 66 and an outer jacket 70.

The coaxial cable 34 is pushed fully into the bore 32 so that the needle-like portion 24 of the probe 18 penetrates the cable 34 and makes contact with the central signal wire 64 of the coaxial cable 34. At this point, the screw member 44 may be advanced within the bore 38 so that the knife edge 62 cuts through the outer jacket 70 and ground braid 68 into the insulating layer 66 of the cable 34 as shown in FIG. 1. The head 46 of the screw member 44 in cooperation with the counter bore 46 controls the depth of penetration of the knife edge 62 into the coaxial cable 34. The depth of the counter bore 46 and length of the screw member 44 are so dimensioned and configured as to permit penetration of the forward edge 62 of the screw member 44 through the outer jacket 70 and ground braid 68 of the coaxial cable 34 into the insulating layer 66, but stopping short of the central signal wire 64 when the head 46 abuts the counterbore 42.

The pocket 58 in the screw member is of a depth sufficient so that when the screw is fully tightened and penetrates into the coaxial cable in the position shown in FIG. 1, the pocket 58 will contain the material of the coaxial cable cut by the knife edge 62 of the screw member 44 as it is being tightened without putting any actual strain on the cable. In other words, the depth of the pocket 56 is greater than the thickness of the cable 34 that is penetrated by the knife edge 62, thereby providing a space 74 above the outer jacket 70 and bottom of the bore 56 in the screw member 44 as shown in FIG. 1. This arrangement allows the material cut by the knife edge 62 to rise and be fully contained within the pocket 58 of the screw member. As the screw member 44 is tightened and driven into the coaxial cable 34, the force exerted on the cable 34 by the screw member 44 distorts the cable 34 causing a portion of the cable jacket 70 to extrude into the bore 47 in the internal surface of the wall 40 of the base 20. This provides strain relief for the cable 34 and mitigates any axial movement of the cable 34 which could cause the electrical connection to fail.

In the case of the particular connector 10 shown, the screw member 44 provides an electrical path from the ground braid 68 of the coaxial cable 34 through the base 10 to the ground sleeve 16.

It can thus be appreciated that in the in the preferred embodiment, the base member has a radial bore in the internal surface of its side wall opposite to and coaxial with the threaded bore, the end of the screw having the knife edge has a substantially cylindrical pocket centered on the screw centerline and a frustoconical outer surface that tapers toward the centerline, thereby forming a circular knife edge at the diameter of the pocket, and the screw has been advanced sufficiently so that the region of the cable enclosed by the pocket is severed from the remainder of the cable and some of the cable jacket is extruded into the opposite bore.

While the arrangement of the screw member 44 and base 12 was described in connection with one particular type of end connector, it is understood that this was for illustration purposes and the use of the base 12 and particular screw member 44 construction for connection to a coaxial cable can be used with other types of end connectors such as other designs of RCA connectors and various types of RF connectors, such as BNC and F connections, as well as both male and female types. Furthermore, the invention may be used with any type of conductive connection between the inner end of the signal probe 18 and the central signal wire 64 of the cable.

The invention claimed is:

1. A plug connector for use with coaxial cable having a side, an end and a central signal wire comprising:

a base having an axial bore therein defined by a side wall adapted to receive the end of a coaxial cable;

a signal conducting probe member having one end adapted to conductively engage the central signal wire of the coaxial cable;

a threaded bore extending transversely through said side wall; and a threaded screw member having an inner end and an outer end mounted in said transverse bore and adapted to be rotatably driven into the side of a coaxial cable, said screw having a head portion external to said base at said outer end and an integral knife edge at said inner end within the axial bore, said inner end having the knife edge including a pocket therein wherein said knife edge is adapted to cut a portion of the side of the coaxial cable and the volume of said pocket is of a sufficient volume to receive the portion material of the coaxial cable that is cut by the knife edge when said coaxial cable is inserted into the bore and the screw member is tightened; wherein the knife edge is circular and the pocket is substantially cylindrical.

2. The plug connector of claim 1 wherein said screw member includes a head portion and said threaded bore includes a counterbore, said head portion of said screw member engaging said counterbore when fully tightened.

3. The plug connector of claim 1 wherein said screw member has an outer surface, said outer surface being tapered adjacent its inner end to form a knife edge with said pocket.

4. The plug connector of claim 1 wherein of said screw member has a length and said counterbore has a depth that are configured so that the inner end of said screw member does not engage the central signal wire when said coaxial cable is inserted into the bore and the screw member is tightened.

5. The plug connector of claim 1 wherein said pocket in said screw member has a volume greater than the volume of the coaxial cable cut by said knife edge as the screw member is driven into the cable.

6. The plug connector of claim 1 wherein said side wall of said base has an internal surface, said internal surface having a radial bore therein, said radial bore being opposite said threaded bore and coaxial therewith.

7. A plug connector and coaxial cable comprising:

a base having an axial bore therein defined by a side wall;

a coaxial cable having an outer jacket, a conductive ground layer, a central signal wire and an insulating layer between said ground layer and said central signal wire, said cable having one end coaxially received within said axial bore;

a signal conducting probe member having one end in conductive contact with said central signal wire of said coaxial cable;

a threaded bore extending transversely through said side wall; and a threaded screw member having an inner end and an outer end mounted in said bore and rotatably advanced into said coaxial cable, said screw having a head portion at its outer end accessible from outside the base and a knife edge at its inner end, said inner end having the knife edge including a pocket enclosing a portion of the cable jacket adjacent said knife edge wherein said knife edge is adapted to cut a portion of the coaxial cable, said pocket of said screw member has a volume and said cut portion of said coaxial cable has a volume, said volume of said pocket being greater than the volume of material of the portion of the coaxial cable cut by said knife edge as the screw member is driven into the cable;

wherein the knife edge is circular and the pocket is substantially cylindrical.

8. The plug connector and coaxial cable of claim 7 wherein said screw member is driven into said coaxial cable to a point wherein its inner end is within said insulation layer, but stops short of said central signal wire.

9. The plug connector and coaxial cable of claim 7 wherein said threaded bore includes a counterbore, said head portion of said screw member engaging said counterbore when fully advanced.

10. The plug connector and coaxial cable of claim 7 wherein said screw member has an outer surface, said outer surface being tapered adjacent its inner end to from a knife edge with said pocket.

11. The plug connector coaxial cable of claim 7 wherein of said screw member has a length and said counterbore has a depth that are configured so that the inner end of said screw member does not engage the central signal wire when the screw is tightened.

12. The plug connector and coaxial cable of claim 7 wherein said wall of said base has an internal surface, said internal surface having a radial bore therein opposite said threaded bore, said radial bore being coaxial with said threaded bore, a portion of said coaxial cable being extruded into said radial bore when said screw is driven into said cable.

13. The plug connector and coaxial cable of claim 7 wherein the portion of the cable enclosed by the pocket is severed from the remainder of the cable.

14. The plug and coaxial cable of claim 7 wherein the inner end of the screw having the knife edge has a substantially cylindrical pocket centered on the screw centerline and a frustoconical outer surface that tapers toward said centerline, thereby forming a circular knife edge at the diameter of the pocket.

15. The plug and coaxial cable of claim 14 wherein said base has an internal surface, said internal surface having a radial bore therein opposite said threaded bore, said radial bore being coaxial with said threaded bore, a portion of said coaxial cable being extruded into said radial bore when said screw is driven into said cable; and the portion of the cable enclosed by the pocket is severed from the remainder of the cable.

* * * * *

UNITED STATES PATENT AND TRADEMARK OFFICE

CERTIFICATE OF CORRECTION

PATENT NO. : 7,476,119 B2
APPLICATION NO. : 11/788945
DATED : January 13, 2009
INVENTOR(S) : D'Addario et al.

It is certified that error appears in the above-identified patent and that said Letters Patent is hereby corrected as shown below:

Column 4:

Line 21, after "therein" insert --;--.

Line 67, after "edge" first occurrence, insert --;--.

Signed and Sealed this

Sixteenth Day of June, 2009

John Doll

JOHN DOLL
*Acting Director of the United States Patent and Trademark Office*